US009669438B2

(12) United States Patent
Ito et al.

(10) Patent No.: US 9,669,438 B2
(45) Date of Patent: Jun. 6, 2017

(54) ROLLING APPARATUS AND ROLLING MONITORING METHOD

(71) Applicant: NIPPON STEEL & SUMITOMO METAL CORPORATION, Tokyo (JP)

(72) Inventors: Kensaku Ito, Tokyo (JP); Takeshi Kinomoto, Tokyo (JP); Genji Ono, Tokyo (JP); Ryoh Izumi, Tokyo (JP); Yasuhiro Tateishi, Tokyo (JP); Ryuichi Kano, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 281 days.

(21) Appl. No.: 14/394,878

(22) PCT Filed: Apr. 23, 2013

(86) PCT No.: PCT/JP2013/061822
§ 371 (c)(1),
(2) Date: Oct. 16, 2014

(87) PCT Pub. No.: WO2013/161780
PCT Pub. Date: Oct. 31, 2013

(65) Prior Publication Data

US 2015/0082848 A1 Mar. 26, 2015

(30) Foreign Application Priority Data

Apr. 24, 2012 (JP) ..... 2012-099124

(51) Int. Cl.

| | |
|---|---|
| ***B21B 38/00*** | (2006.01) |
| ***B21C 51/00*** | (2006.01) |
| ***B21B 37/68*** | (2006.01) |

(52) U.S. Cl.
CPC ..... *B21B 38/00* (2013.01); *B21B 37/68* (2013.01); *B21C 51/00* (2013.01); *B21B 2273/04* (2013.01)

(58) Field of Classification Search
CPC ..... B21B 37/68; B21B 2273/04; B21B 38/00; B21B 38/02; B21B 1/22; B21B 2203/187;
(Continued)

(56) References Cited

U.S. PATENT DOCUMENTS

| | | | | |
|---|---|---|---|---|
| 6,082,161 | A | 7/2000 | Marushita et al. | |
| 8,919,162 | B2 * | 12/2014 | Moretto | B21B 37/68 72/11.1 |
| 2010/0269556 | A1 | 10/2010 | Moretto et al. | |

FOREIGN PATENT DOCUMENTS

| | | | |
|---|---|---|---|
| CN | 1974040 | A | 6/2007 |
| EP | 2 014 380 | A1 | 1/2009 |

(Continued)

OTHER PUBLICATIONS

JP10207530A is attached.*

(Continued)

*Primary Examiner* — Peter DungBa Vo
*Assistant Examiner* — John S Lowe
(74) *Attorney, Agent, or Firm* — Birch, Stewart, Kolasch & Birch, LLP

(57) ABSTRACT

[Object] To provide a rolling apparatus that enables an operator to recognize the rolling status such as the behavior of the steel sheet entering the rolling stand and enables a stable rolling process.

[Solution] A rolling apparatus 10 includes a plurality of rolling stands 11 each including a pair of rolling mills 12, and an imaging unit 15 provided between adjacent rolling stands 11A and 11B, the imaging unit 15 being configured to image a steel sheet 1 entering a pair of rolling mills 12B of (Continued)

the rolling stand 11B from an upstream side of the rolling stand 11A located on a downstream side in a rolling direction. The imaging unit 15 is disposed so as to satisfy the following equation (1), on the upstream side in the rolling direction Z of the rolling stand 11B, in a central portion in the width direction of the steel sheet in an area P in which the steel sheet 1 is able to be conveyed:

$$2 \times L \times \tan(\alpha/2) > W_{max} \quad (1)$$

wherein L represents a distance in the rolling direction between the rolling stand 11B located on the downstream side in the rolling direction and the imaging unit 15, $\alpha$ represents a horizontal viewing angle of the imaging unit, and $W_{max}$ represents a maximum width of the steel sheet 1.

7 Claims, 7 Drawing Sheets

(58) Field of Classification Search
CPC ... B21C 51/00; G01B 11/2513; G01B 11/303; G01B 11/306; G01B 11/2504; G01N 21/8806; G01N 21/89; G01N 21/95684; G06T 7/00
See application file for complete search history.

(56) References Cited

FOREIGN PATENT DOCUMENTS

| | | | | |
|---|---|---|---|---|
| JP | 63-236910 | A | | 10/1988 |
| JP | 10-207530 | A | | 8/1998 |
| JP | 10207530 | A | * | 8/1998 |
| JP | 2000-42615 | A | | 2/2000 |
| JP | 2004-141956 | A | | 5/2004 |
| JP | 2011-257967 | A | | 12/2011 |

OTHER PUBLICATIONS

Machine translation of JP10207530A is attached.*
Machine translation JP10207530A is attached.*
International Search Report for PCT/JP2013/061822 mailed on Aug. 6, 2013.
Written Opinion of the International Searching Authority for PCT/JP2013/061822 mailed on Aug. 6, 2013.
Extended European Search Report, dated Nov. 17, 2015, for corresponding European Application No. 13781927.2.
Office Action issued in corresponding European Application No. 13 781 927.2-1702 on Nov. 29, 2016.

* cited by examiner

ROLLING APPARATUS AND ROLLING MONITORING METHOD

TECHNICAL FIELD

The present invention relates to a rolling apparatus that executes stable rolling by monitoring the behavior and the like of a steel sheet that is rolled, and a rolling monitoring method of the steel sheet.

BACKGROUND ART

In a case of rolling a steel sheet by using rolling stands each having a pair of rolling mills, the steel sheet may sometimes "meander"; that is, conveying positions of the steel sheet may vary in the width direction of the rolling mills. Since side guides that guide the width-directional position of the steel sheet are disposed on the entering side of each of the rolling stands, a largely meandering steel sheet has contacted with either of the side guides in some cases.

In a case where the steel sheet contacts with either of the side guides, a fractured piece of the steel sheet may scatter and be pressed into the steel sheet, which may form a defective steel sheet. Further, in a case where the fractured piece pressed into the rolling mill generates a scratch on the surface of the mill, the scratch on the mill will probably be transferred on a steel sheet that is rolled. In this case, the rolling mill needs to be replaced with a new one, failing to execute an efficient rolling process.

Accordingly, Patent Documents 1 and 2 as the related art, for example, propose methods of measuring and controlling the meandering of the steel sheet. Patent Document 1 proposes a method of detecting the meandering on the basis of a deviation of a rolling load in the width direction of the rolling stand so as to adjust the roll gap, for example. Patent Document 2 proposes a method of measuring the meandering amount of the steel sheet by imaging, with an imaging unit, a steel sheet that is conveyed between rolling stands in a final rolling apparatus of a hot-rolled steel sheet, the apparatus including a plurality of rolling stands that are lined up in the rolling direction.

PRIOR ART DOCUMENT(S)

Patent Document(s)

[Patent Document 1] JP 2000-042615A
[Patent Document 2] JP 2004-141956A

SUMMARY OF THE INVENTION

Problem(s) to be Solved by the Invention

In Patent Document 1, unfortunately, it has been impossible to detect the meandering amount accurately because the meandering amount is calculated on the basis of the deviation of the rolling load in the width direction of the rolling mill and therefore the calculation is largely affected by the shape of the rolling mill itself, thickness distribution in the width direction of the sheet itself, and the like. Further, in Patent Document 2, although it is possible to measure the meandering amount between the rolling stands because the imaging unit images the steel sheet conveyed between the rolling stands, it has been impossible to measure the meandering amount of the steel sheet at the position where the steel sheet enters the rolling stand.

Furthermore, on the entering side of the rolling stand, the steel sheet does not only meander in the width direction but also is deformed in some cases by variations in the thickness direction. The techniques disclosed in Patent Documents 1 and 2 have failed to examine such deformation of the steel sheet sufficiently. Therefore, it has been difficult to surely prevent the contact between the steel sheet and the side guide provided on the rolling stand and to execute stable rolling of the steel sheet.

The present invention has been made in view of the aforementioned circumstances, and aims to provide a rolling apparatus that enables an operator to recognize the rolling status such as the behavior of the steel sheet entering the rolling stand and enables a stable rolling process, and a rolling monitoring method of the steel sheet.

Means for Solving the Problem(s)

In order to solve at least one of the above problems, the rolling apparatus according to the present invention includes a plurality of rolling stands each including a pair of rolling mills, and an imaging unit provided between adjacent rolling stands, the imaging unit being configured to image a steel sheet entering the pair of rolling mills of the rolling stand from an upstream side in a rolling direction of the rolling stand located on a downstream side in the rolling direction. The imaging unit is disposed so as to satisfy the following equation (1), on the upstream side in the rolling direction of the rolling stand located on the downstream side in the rolling direction, in a central portion in the width direction of the steel sheet in an area in which the steel sheet is able to be conveyed:

$$2\times L\times\tan(\alpha/2)>W_{max} \quad (1)$$

wherein L represents a distance in the rolling direction between the rolling stand and the imaging unit, $\alpha$ represents a horizontal viewing angle of the imaging unit, and $W_{max}$ represents a maximum width of the steel sheet.

The rolling apparatus having the above configuration includes the imaging unit configured to image the steel sheet entering the pair of rolling mills. From an image obtained by the imaging unit, the operator can recognize the meandering or deformation of the steel sheet at the position where the steel sheet enters the rolling stand. In this manner, it becomes possible to recognize the rolling status such as the behavior of the steel sheet from an image. Further, on the basis of the recognized rolling status of the steel sheet, for example, the operator can perform an operation to prevent a touch between the steel sheet and the side guides provided on the rolling stand. Furthermore, by providing the imaging unit within the above range, it becomes possible to image, with a single imaging unit, the steel sheet entering the pair of rolling mills. The use of such a rolling apparatus makes it possible to execute stable control of the meandering and shape of the steel sheet and to manufacture a quality rolled steel sheet.

Here, the imaging unit may be disposed within a range of 0.5 m in the width direction of the steel sheet from the center in the width direction of the steel sheet in the area in which the steel sheet is able to be conveyed. The provision of the imaging unit within the above range makes it possible to image, with a single imaging unit, the steel sheet entering the pair of rolling mills. The operator can recognize the behavior of the steel sheet entering the pair of rolling mills surely from an image obtained by the imaging unit and also can recognize the behavior of the steel sheet intuitively.

Further, the imaging unit may be disposed at a height to image the steel sheet entering the pair of rolling mills at a tilt angle θ with respect to the rolling direction of the steel sheet, and the tilt angle θ may be smaller than or equal to 20°. The disposition of the imaging unit at that position makes it possible to image the steel sheet entering the pair of rolling mills. The operator can recognize the behavior of the steel sheet entering the pair of rolling mills accurately from an image obtained by the imaging unit.

Further, the horizontal viewing angle α of the imaging unit may be smaller than or equal to 50°. The use of such an imaging unit reduces a strain of an obtained image, and accordingly, it becomes possible to recognize the behavior of the steel sheet entering the pair of rolling mills accurately from the obtained image.

A rolling monitoring method of a steel sheet according to the present invention is a rolling monitoring method of a steel sheet to monitor a rolling status of a steel sheet that is rolled by a plurality of rolling stands each including a pair of rolling mills, the rolling monitoring method including imaging the steel sheet entering the pair of rolling mills with an imaging unit disposed between adjacent rolling stands so as to satisfy the following equation (1), on an upstream side in a rolling direction of the rolling stand located on a downstream side in the rolling direction, in a central portion in a width direction of the steel sheet in an area in which the steel sheet is able to be conveyed, and displaying, on a display apparatus, an image of the steel sheet entering the pair of rolling mills, the image being obtained by the imaging unit:

$$2\times L\times\tan(\alpha/2)>W_{max} \quad (1)$$

wherein L represents a distance in the rolling direction between the rolling stand and the imaging unit, α represents a horizontal viewing angle of the imaging unit, and $W_{max}$ represents a maximum width of the steel sheet.

According to the above rolling monitoring method of the steel sheet, the imaging unit images the steel sheet entering the pair of rolling mills. The operator can recognize the rolling status of the steel sheet from an image obtained by the imaging unit and adjust rolling conditions in accordance with the meandering or deformation of the steel sheet, thereby executing a stable rolling process of the steel sheet.

Further, according to the rolling monitoring method, when it is determined that, as a result of an image analysis of the image of the steel sheet, detection conditions for detecting a specific rolling status of the steel sheet are satisfied, a warning may be issued. By making it possible to automatically detect the specific rolling status of the steel sheet through image analysis of the obtained image, the monitoring load on the operator can be reduced.

Effect(s) of the Invention

According to the present invention, it becomes possible to provide a rolling apparatus that enables an operator to recognize a rolling status such as the behavior of a steel sheet entering the rolling stand and enables a stable rolling process, and to provide a rolling monitoring method of the steel sheet.

BRIEF DESCRIPTION OF THE DRAWING(S)

MODE(S) FOR CARRYING OUT THE INVENTION

The rolling apparatus and the rolling monitoring method of the steel sheet each according to an embodiment of the present invention will be described below with reference to the appended drawings. A rolling apparatus 10 and a rolling monitoring method of a steel sheet according to this embodiment are used in a final rolling step in a hot-rolling line of a steel sheet 1.

Figure 1:
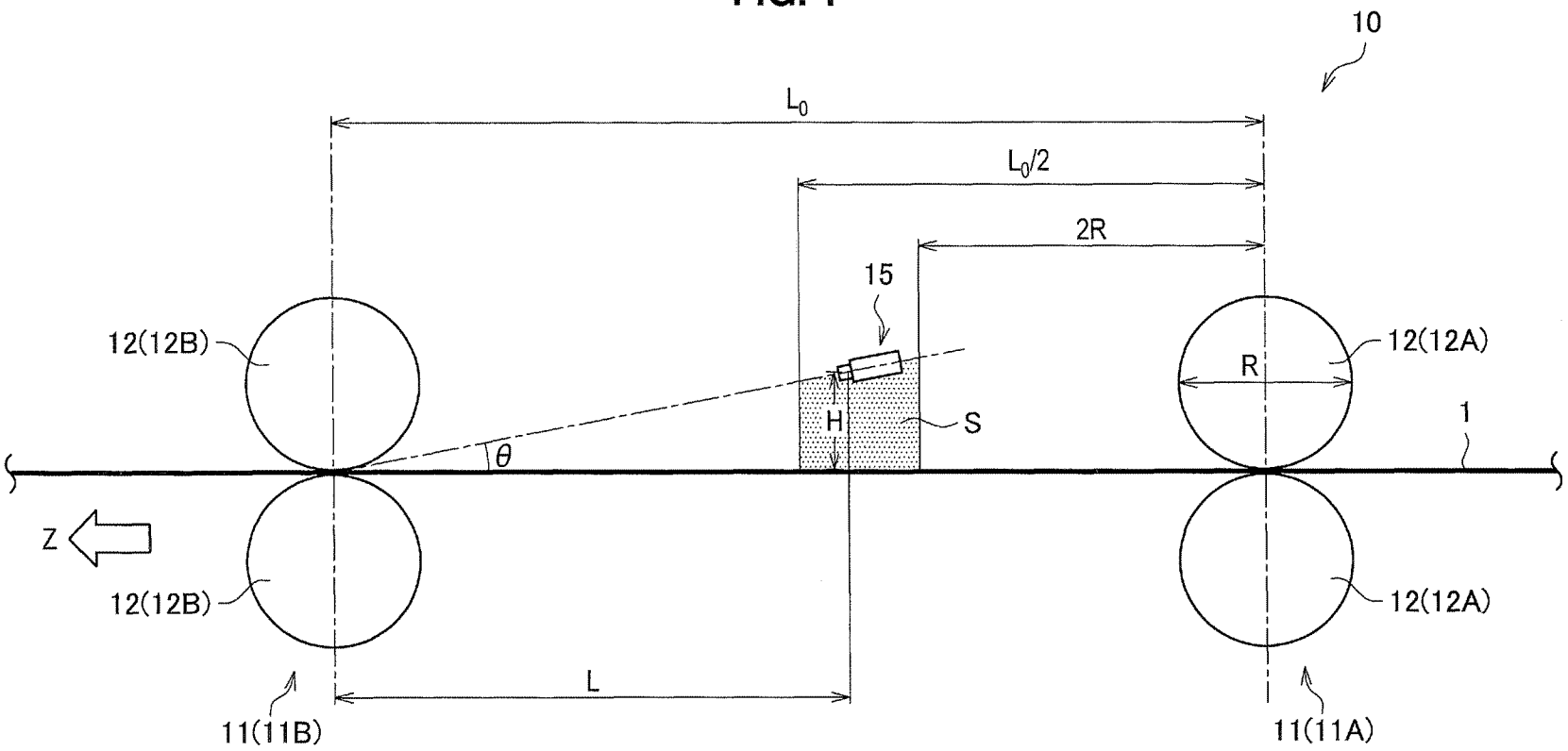
FIG. 1 is a side view showing a rolling apparatus according to an embodiment of the present invention.
Figure 2:
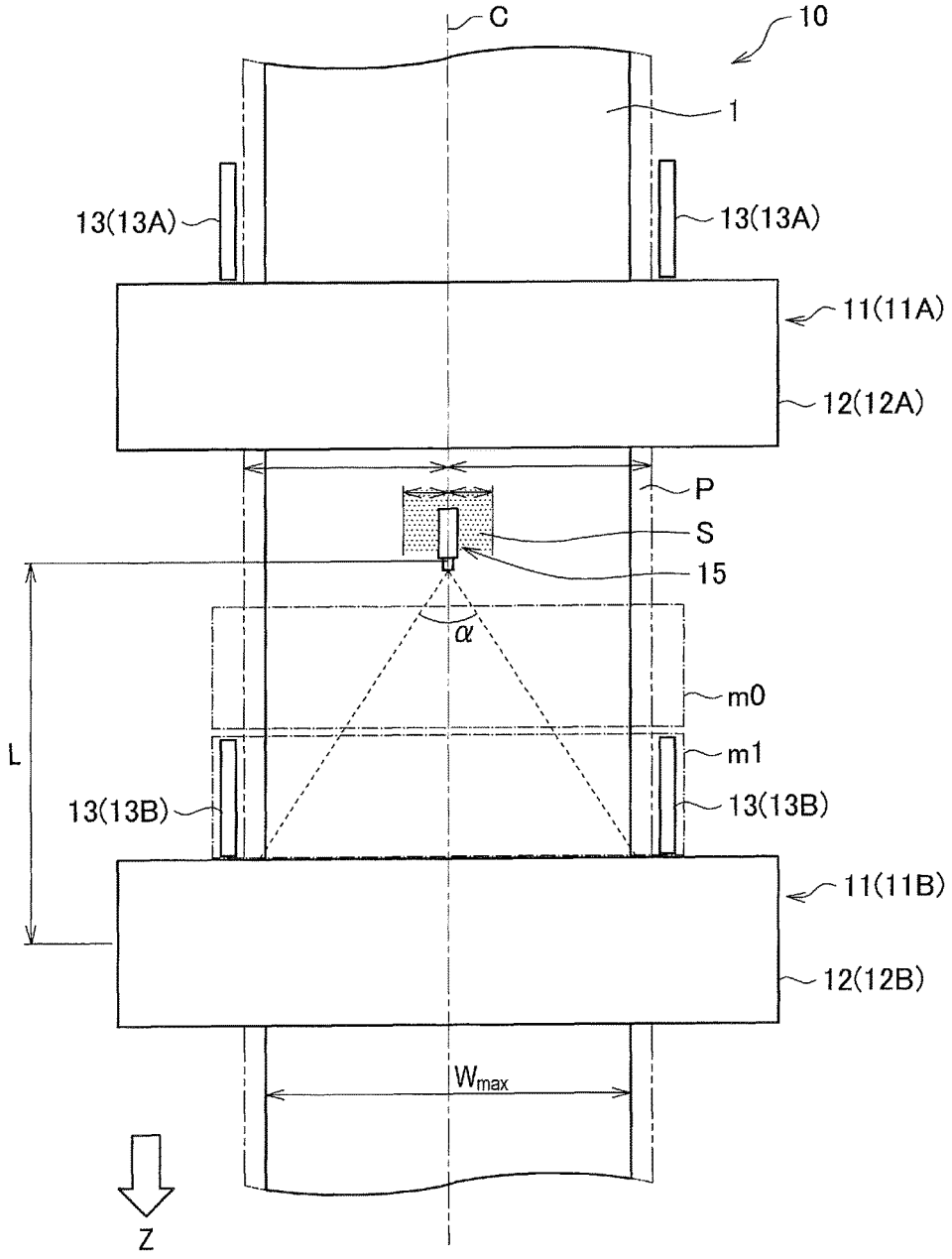
FIG. 2 is a top view showing the rolling apparatus according to the embodiment.

The rolling apparatus 10 includes a plurality of rolling stands 11 arranged in series along a rolling direction Z. FIGS. 1 and 2 show two rolling stands 11A and 11B which are adjacent to each other from among the plurality of rolling stands 11. Each of the rolling stands 11 (11A and 11B) includes a pair of rolling mills 12 (12A and 12B) disposed in the vertical direction, and the entering side of each of the rolling stands 11 (11A and 11B) includes side guides 13 (13A and 13B) which guide the width-direction position of the conveyed steel sheet 1.

An imaging camera unit 15 is disposed between the two rolling stands 11A and 11B as an imaging unit that images the rolling stand 11B located on the downstream side in the rolling direction Z. The imaging camera unit 15 is located on the upstream side in the rolling direction Z of the rolling stand 11B and images the steel sheet 1 entering the pair of rolling mills 12B of the rolling stand 11B.

Here, as shown in FIG. 2, the imaging camera unit 15 is provided on the upstream side in the rolling direction Z of the rolling stand 11B in a central portion, in the width direction of the steel sheet in an area P in which the steel sheet 1 is able to be conveyed. Note that the central portion in the width direction of the steel sheet in the area P in which the steel sheet 1 is able to be conveyed may have a range of 0.5 m in the width direction of the steel sheet from a center C in the width direction of the steel sheet in the area P in which the steel sheet 1 is able to be conveyed, for example, as shown in FIG. 2.

The imaging camera unit 15 is disposed so as to satisfy the following equation (1):

$$2\times L\times\tan(\alpha/2)>W_{max} \quad (1)$$

wherein L represents a distance in the rolling direction Z between the imaging camera unit 15 and the rolling stand 11B (the center of the rolling mill 12B), α represents a horizontal viewing angle of the imaging camera unit 15, and $W_{max}$ is a maximum width of the steel sheet 1.

The horizontal viewing angle α of the imaging camera unit 15 may be smaller than or equal to 50°, for example. In this embodiment, the horizontal viewing angle α of the imaging camera unit 15 is set to 50°.

Further, the imaging camera unit 15 is disposed at a height to image the steel sheet 1 entering the pair of rolling mills 12B at a tilt angle θ with respect to the rolling direction Z of the steel sheet 1, as shown in FIG. 1. The tilt angle θ may be smaller than or equal to 20°, for example. In this embodiment, the rolling direction Z of the steel sheet 1 is the horizontal direction. Therefore, a height H of the imaging camera unit 15 from the position where the steel sheet 1 is conveyed is represented by the following equation (2).

$$H=L\times\tan\theta \quad (2)$$

Furthermore, the imaging camera unit 15 is disposed between the two rolling stands 11A and 11B which are adjacent to each other in the rolling direction Z, as shown in FIG. 1. Here, the distance between the rolling stands 11A and 11B are represented as $L_0$ and the diameter of the rolling mill 12 is represented as R. In this case, the imaging camera unit 15 may be disposed at any position between a position away from the center of the rolling stand 11A on the upstream side in the rolling direction Z by 2R to the downstream side in the rolling direction Z and a position away from the center of the rolling stand 11A on the upstream side in the rolling direction Z by $L_0/2$ to the downstream side in the rolling direction Z. If the imaging camera unit 15 is disposed beyond the above range to be closer to the rolling stand 11A on the upstream side in the rolling direction Z, it becomes difficult to dispose the imaging camera unit 15 because the imaging camera unit 15 would contact with the rolling stand 11A, for example. In contrast, if the imaging camera unit 15 is disposed beyond the above range to be closer to the rolling stand 11B on the downstream side in the rolling direction Z, it becomes difficult to include a portion where the steel sheet 1 enters the pair of rolling mills 12B within an imaged range.

Accordingly, it is desirable to dispose the imaging camera unit 15 within an installation area S regulated by the above range, as shown in FIGS. 1 and 2. The disposition of the imaging camera unit 15 within the installation area S makes it possible to obtain an image in which at least the portion where the steel sheet 1 enters the pair of rolling mills 12B is included within the imaged range. Further, the imaging camera unit 15 is preferably disposed such that a range ml including the side guides 13B, in addition to the portion where the steel sheet 1 enters, is included in the image. From the image obtained by the imaging camera unit 15 disposed in this manner, the operator can recognize a variety of rolling statuses in the rolling apparatus 10, such as the behavior of the steel sheet 1 at the time of rolling or a fault in equipment of the rolling apparatus 10.

Note that the rolling apparatus 10 includes at least one imaging camera unit 15. In this case, the imaging camera unit 15 is preferably provided at a position where the portion at which the steel sheet 1 enters the pair of rolling mills 12 of the rolling stand 11 can be imaged, the rolling stand 11 being located at the downstream end in the rolling direction Z from among the plurality of rolling stands 11. Further, if the imaging camera unit 15 is disposed at each space between the plurality of rolling stands 11, images obtained by the respective imaging camera units 15 can be compared or analyzed. This enables recognition of the rolling statuses in each of the rolling stands 11, changes of the rolled steel sheet 1, and the like.

Next, the imaging camera unit 15 included in the rolling apparatus 10 according to this embodiment will be described with reference to FIG. 3. In the environment of a hot-rolling line in which the steel sheet 1 is rolled, a large number of fine particles, much vapor, and the like are generated and heat load is heavy. Accordingly, the imaging camera unit 15 is required to have a durability to be able to operate even in a harsh environment.

Figure 3:
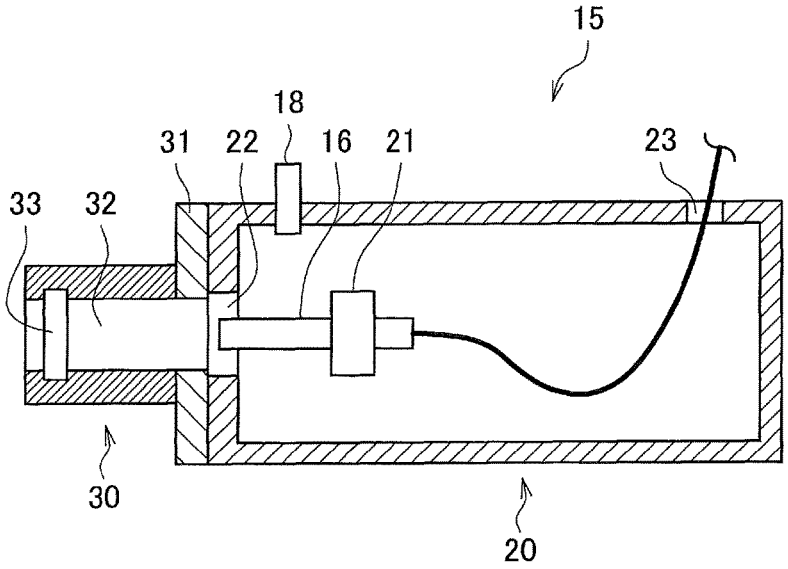
FIG. 3 is a schematic view showing an imaging camera unit included in the rolling apparatus according to the embodiment.

The imaging camera unit 15 according to this embodiment includes a case main part 20, a case lens part 30, a camera main body 16, and an air supply part 18 which supplies air to the case main part 20, as shown in FIG. 3.

The case main part 20 includes a fixing part 21 which fixes the camera main body 16, a camera window part 22 disposed in front of the camera main body 16, and an insertion through hole 23 through which wiring of the camera main body 16 is inserted. Here, the fixing part 21 is configured to be able to fix the camera main body 16 firmly so as not to cause a position shift of the camera main body 16 owing to vibration or the like. Further, in terms of improving the durability, the case main part 20 is made of a stainless steel having a thickness of 1 cm or more, for example. Note that in the case main part 20, in order to prevent a cable inserted through the insertion through hole 23 from being heated, one opening may be commonly used as the air supply part 18 and the insertion through hole 23.

The case lens part 30 includes a flange part 31 which is connected detachably to the case main part 20, a lens opening 32 which communicates with the camera window part 22 of the case main part 20, and a lens 33 disposed in the lens opening 32. Note that air is also supplied to the case lens part 30.

The imaging camera unit 15 images the steel sheet 1 entering the rolling stand 11B with the camera main body 16 through the lens 33, the lens opening 32, and the camera window part 22.

The rolling apparatus 10 having the above configuration allows the steel sheet 1 to be conveyed from the upstream side in the rolling direction Z to the downstream side in the rolling direction Z, and rolls the steel sheet 1 with the plurality of rolling stands 11. During this process, the imaging camera unit 15 disposed between the adjacent rolling stands 11, as described above, images the steel sheet 1 entering the pair of rolling mills 12B of the rolling stand 11 on the downstream side in the rolling direction Z. The image obtained by the imaging camera unit 15 is displayed on a display apparatus (not shown). The operator monitors the behavior of the steel sheet 1 while watching the image displayed on the display apparatus.

Figure 4:
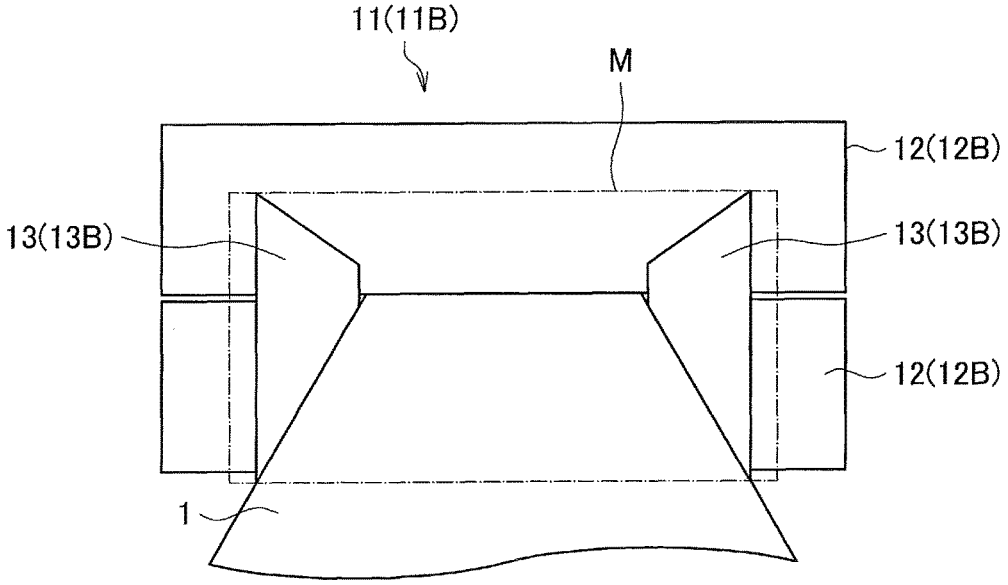
FIG. 4 is a schematic view showing an image obtained by the imaging camera unit included in the rolling apparatus according to the embodiment.

FIG. 4 shows an example of the image displayed on the display apparatus. For example, a part within a display area M in FIG. 4 is displayed on the display apparatus. The image obtained by the imaging camera unit 15 includes the portion at which the conveyed steel sheet 1 enters the pair of rolling mills 12B, the steel sheet 1 entering the pair of rolling mills 12B, and side guides on both sides in the width direction of the steel sheet 1. That is, the imaging camera unit 15 is disposed at a position that enables obtaining an image by which the position relation between the steel sheet 1 entering the pair of rolling mills 12B and the side guides 13B can be recognized.

The operator recognizes the meandering and deformation of the steel sheet 1 from the image obtained by the imaging camera unit 15 and adjusts leveling setting of the rolling stand 11A on the upstream side, setting of a bender, setting of the side guides 13A and 13B, and the like. In this manner, the final rolling of the steel sheet 1 is executed.

From the image obtained by the imaging camera unit 15, the operator can recognize the following behavior of the steel sheet 1, for example.

Use Example 1

Figure 5:
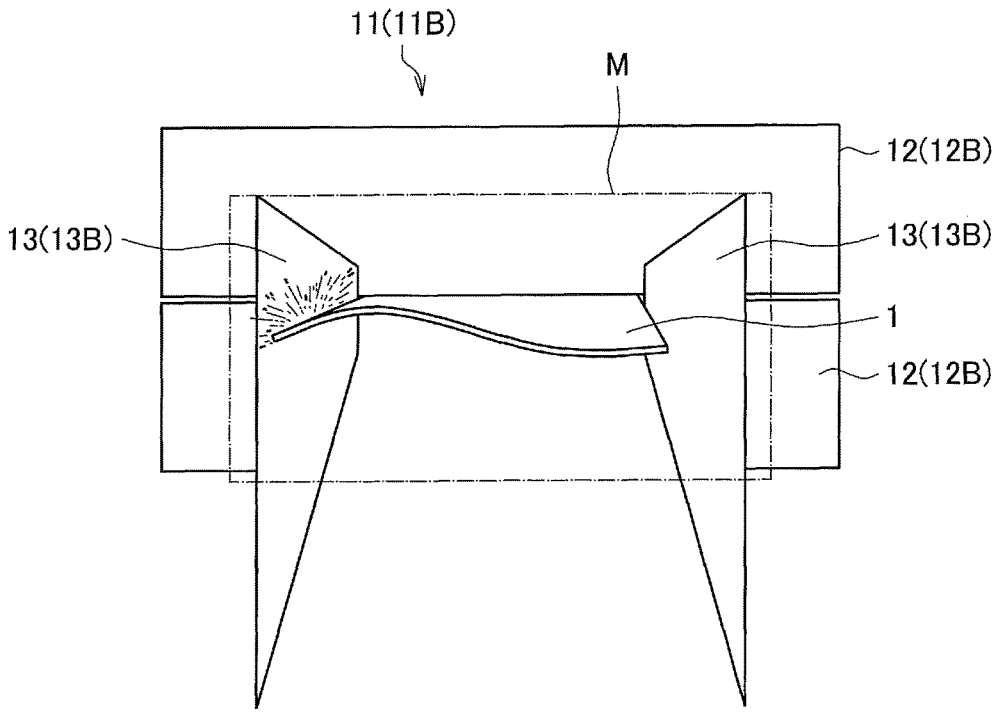
FIG. 5 is a schematic view showing an example of a behavior of a steel sheet that is monitored by use of the image obtained by the imaging camera unit according to the embodiment, and showing a state in which a bottom portion of the steel sheet is bent.

In some cases where the steel sheet 1 conveyed through the hot-rolling line meanders, at a bottom portion of the steel sheet 1, a side edge of the steel sheet 1 contacts with the side guide 13B and becomes bent, and the steel sheet 1 enters the rolling mills 12B, having portions locally folded, as shown in FIG. 5, for example. This phenomenon is called "Shibori" in Japanese language. Once such a phenomenon occurs, a scratch is generated on the rolling mill 12B, so that the mill needs to be replaced with new one and the process is suspended.

Conventionally, the state of the steel sheet 1 conveyed from the side guides 13B to the portion where the steel sheet 1 enters the pair of rolling mills 12B cannot be recognized because there is no means for monitoring the state directly. Accordingly, conventionally, it has been determined whether the steel sheet 1 meanders or not, for example, on the basis of the deviation of a load in the width direction of the steel sheet with respect to a load cell provided on a looper or the deviation of a load in the width direction of the steel sheet with respect to the load cell provided on the rolling stand 11B. Alternatively, it has been determined whether the steel sheet 1 meanders or not, on the basis of an image obtained by an imaging unit from a side or a top of the conveyed steel sheet 1.

However, the absolute quantity of the meandering of the steel sheet 1 cannot be obtained from the deviation of the load with respect to the load cell of the looper. Further, in a case where the steel sheet 1 is away from the looper, such as in a case where the end of the steel sheet is conveyed, the deviation of the load with respect to the load cell cannot be obtained, and accordingly, the meandering of the steel sheet 1 cannot be determined. On the other hand, in a case of using the deviation of the load with respect to the load cell of the rolling stand 11B, it is impossible to separate the deviation of the load to one that attributes to the meandering of the steel sheet 1 and one that attributes to a wedge (difference in thickness across the width direction of the steel sheet).

Further, in a case of using the image obtained by imaging the steel sheet 1 from the side or the top, the range where the steel sheet 1 can be imaged from the top is, for example, a range where the steel sheet 1 conveyed between the adjacent rolling stands 11A and 11B is imaged, such as a range m0 in FIG. 2. In a case where the steel sheet 1 is imaged from the side, it is difficult to dispose an imaging unit at a position where the portion of the steel sheet 1 entering the rolling mills 12B can be imaged, and accordingly, an image of the steel sheet 1 conveyed between the rolling stands 11A and 11B is obtained. Therefore, the image does not include the portion of the steel sheet 1 entering the pair of rolling mills 12B. Accordingly, the behavior of the steel sheet 1 entering the pair of rolling mills 12B is estimated from the image, and on the basis of the estimation, it is determined whether the steel sheet 1 meanders or not. However, the estimated behavior of the steel sheet 1 may differ from the actual behavior of the steel sheet 1 and the meandering of the steel sheet 1 is not always recognized accurately.

In contrast, by disposing the imaging camera unit 15 as in the rolling apparatus 10 according to this embodiment, the steel sheet 1 entering the pair of rolling mills 12B can be imaged. Therefore, the obtained image includes the portion of the steel sheet 1 actually entering the pair of rolling mills 12B, and on the basis of the image, the operator can recognize the behavior of the steel sheet 1 accurately. For example, as shown in FIG. 5, it is possible to recognize the following behaviors of the steel sheet 1: entering the position where the side guides 13B are installed; buckling owing to contact between a side edge of the steel sheet and the side guide 13B; and entering the pair of rolling mills 12B while folding. It is difficult to estimate such behaviors from an image obtained by imaging the range on the upstream side in the rolling direction Z with respect to the side guides 13B.

Use Example 2

Figure 6:
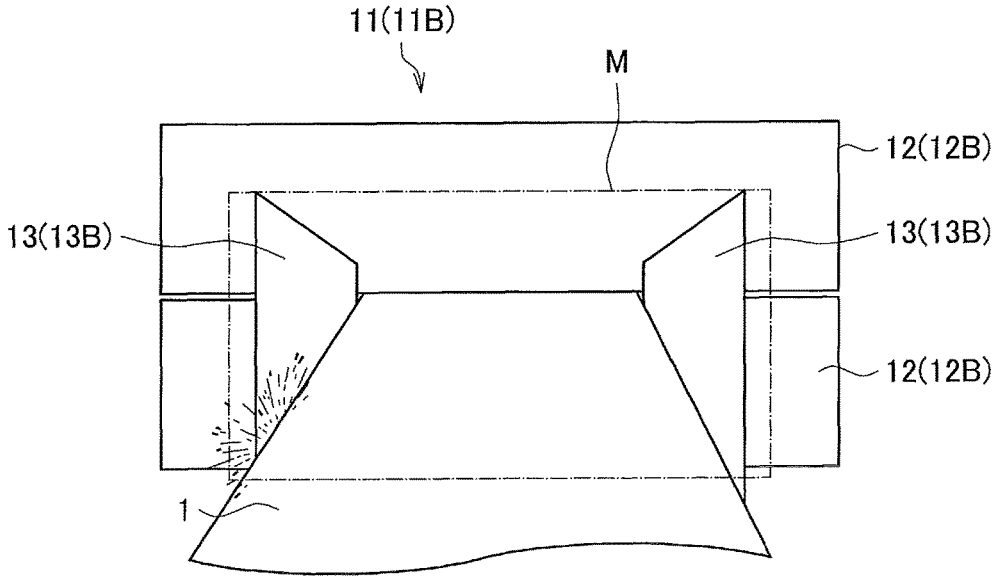
FIG. 6 is a schematic view showing another example of the behavior of the steel sheet that is monitored by use of the image obtained by the imaging camera unit according to the embodiment, and showing a state in which the steel sheet contacts with a side guide.

When the steel sheet 1 conveyed in the hot-rolling line meanders, a side edge at any of a top portion, a middle portion, and a bottom portion of the steel sheet 1 may contact with either of the side guides 13B, as shown in FIG. 6, for example. The contact between the steel sheet 1 and the side guide 13B generates a fractured piece of the steel sheet 1 and it scatters. When the scattered piece is rolled by the pair of rolling mills 12B together with the steel sheet 1, a plunge defect is generated on the steel sheet 1.

The touch between the steel sheet 1 and the side guide 13B has been determined conventionally on the basis of an image obtained by an imaging unit imaging the conveyed steel sheet 1 from the side or the top. However, the position where the imaging unit can be disposed is limited to the upstream side in the rolling direction Z with respect to the side guides 13B between the adjacent rolling stands 11A and 11B. Therefore, the portion where the steel sheet 1 is conveyed between the side guides 13B is not included in the image. Accordingly, from this image, the behavior of the steel sheet 1 with respect to the side guides 13B is estimated, and on the basis of this estimation, the degree of contact between the steel sheet 1 and the side guide 13B is determined. However, the estimated behavior of the steel sheet 1 may differ from the actual behavior of the steel sheet 1, and accordingly, the degree of contact between the steel sheet 1 and the side guide 13B may not always be recognized accurately.

In contrast, by disposing the imaging camera unit 15 as in the rolling apparatus 10 according to this embodiment, the steel sheet 1 conveyed between the side guides 13B can be imaged. Therefore, the obtained image includes the portion where the steel sheet 1 is actually conveyed between the side guides 13B, and on the basis of the image, the operator can recognize the behavior of the steel sheet 1 accurately. For example, when the steel sheet 1 enters the position where the side guides 13B are installed, as shown in FIG. 6, the operator can recognize clearly the state where a side edge of the steel sheet touches with the side guide 13B and fractured pieces are scattered with sparks. It is difficult to estimate such a behavior from an image obtained by imaging the range on the upstream side in the rolling direction Z with respect to the side guides 13B.

Note that the generation of sparks of the steel sheet 1 is desirably recognized automatically through an image analysis of an image obtained by the imaging camera unit 15. Usually, in the obtained image, portions other than the area where the steel sheet 1 is able to be conveyed are displayed in black because the temperature is low. Accordingly, when sparks are generated, the sparks appear as red spots in the black portions. These red spots are detected through an image analysis, and thus the generation of sparks can be recognized automatically. That is, a red spot in the image is a detection condition for detecting the generation of sparks of the steel sheet 1.

The image analysis of the image obtained by the imaging camera unit 15 is executed by a monitoring apparatus (not shown) that monitors the rolling status of the steel sheet 1 by analyzing the image, for example. The rolling status of the steel sheet 1, monitored by the monitoring apparatus, includes a variety of statuses in the rolling apparatus 10, such as the behavior of the steel sheet 1 at the time of rolling and a fault in the equipment of the rolling apparatus 10. The monitoring apparatus is achieved by a computer, for example, and a CPU included therein executes an image analysis program so that the computer can function as the monitoring apparatus. The image analysis program may be stored in a storage apparatus included in the computer or a computer-readable storage medium such as a magnetic disk or an optical disk.

The monitoring apparatus, for example, analyzes the image obtained by the imaging camera unit 15, and when the generation of red spots is detected in the image, issues a warning to the operator. The warning may be issued by a display of the warning content on a display apparatus or by sound using a sound output apparatus such as a speaker (not shown), for example. Having received the warning from the monitoring apparatus, the operator checks the rolling status of the steel sheet 1 in the rolling apparatus 10, and may adjust setting or the like as necessary. In this manner, by enabling the image analysis of the obtained image and automatic detection of a specific behavior of the steel sheet 1, such as the generation of sparks of the steel sheet 1, the monitoring load on the operator can be reduced.

Use Example 3

When the top portion or the bottom portion of the steel sheet 1 has an abnormal sharp shape, usually, it becomes difficult to convey the portion having the abnormal sharp shape to the rolling stand 11. In a case of an abnormal sharp shape, depending on the shape such as a fish tail, a tongue, or a side sharp shape, an appropriate leveling operation or a bender operation is needed. Therefore, it is required to recognize the sharp shape of the steel sheet 1 accurately.

Conventionally, the sharp shape of the steel sheet 1 has been determined on the basis of an image obtained by an imaging unit imaging the conveyed steel sheet 1 from the side or the top. However, since the steel sheet 1 is conveyed at a high speed, it is difficult to recognize the sharp shape of the conveyed steel sheet 1 by seeing the image obtained by the imaging unit.

Accordingly, by disposing the imaging camera unit 15 as in the rolling apparatus 10 according to this embodiment, it becomes possible to obtain an image in which the sharp shape of the steel sheet 1 is easily recognized. That is, the imaging camera unit 15 is disposed at a height to image the steel sheet 1 entering the pair of rolling mills 12B at a tilt angle θ with respect to the rolling direction Z of the steel sheet 1. The tilt angle θ is smaller than or equal to 20°. For example, in a case where the tilt angle θ is 20°, the speed of conveying the steel sheet 1 in the image obtained by the imaging camera unit 15 becomes approximately 0.34 times (i.e., sin 20° times) as high as the actual speed of conveying the steel sheet 1.

Figure 7:
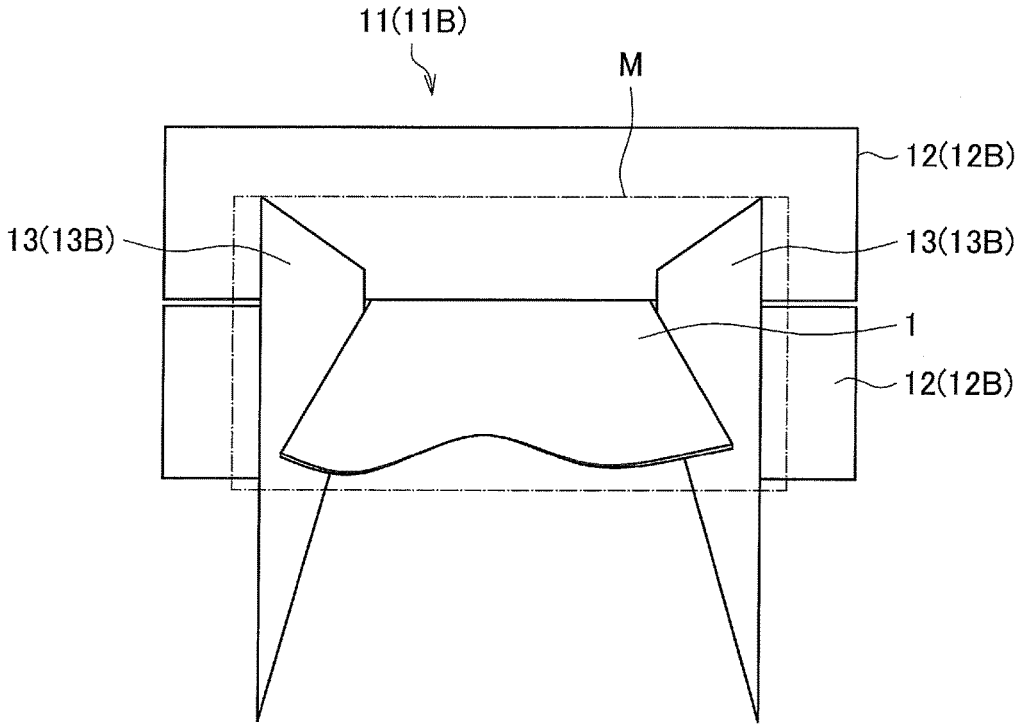
FIG. 7 is a schematic view showing an example in which a sharp shape of the steel sheet is monitored by use of the image obtained by the imaging camera unit according to the embodiment.

Therefore, as shown in FIG. 7, for example, the steel sheet 1 seems to be conveyed at a lower speed than the actual speed of conveying the steel sheet 1 for the operator monitoring the image obtained by imaging the steel sheet 1 from the top obliquely. Accordingly, it becomes easier to recognize the sharp shape of the steel sheet 1. Thus, the operator can recognize the sharp shape accurately, and can execute a leveling operation or a bender operation easily at a top portion and a bottom portion of the steel sheet 1.

Use Example 4

An opening in the steel sheet 1 being conveyed leads to a serious trouble, such as incompletion, for example, strip rupture in finishing stands. In order to minimize damage caused by such a trouble, it is required to be able to detect, at an early stage, a portion of the steel sheet 1 that is likely to open or a portion having an opening.

Since the opening of the steel sheet 1 has a lower temperature than other portions, the opening is displayed in a different color. Conventionally, by use of this difference in color, on the basis of an image obtained by an imaging unit imaging the conveyed steel sheet 1 from the side or the top, the opening of the steel sheet 1 has been determined. However, when the opening of the steel sheet 1 is detected on the basis of such determination, in many cases, it has already become difficult to repair the opening.

Figure 8:
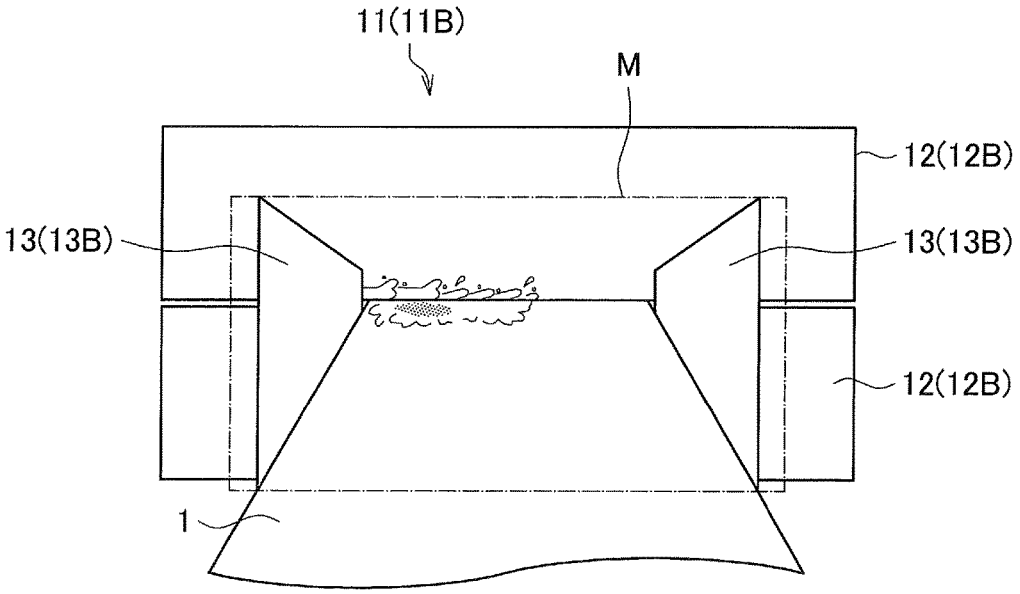
FIG. 8 is a schematic view showing an example in which a sign of opening in the steel sheet is monitored by use of the image obtained by the imaging camera unit according to the embodiment.

In contrast, by disposing the imaging camera unit 15 as in the rolling apparatus 10 according to this embodiment, the steel sheet 1 entering the pair of rolling mills 12B can be imaged. From an image obtained by the imaging camera unit 15, the present inventors have found out that water spouts from the portion of the steel sheet 1 entering the pair of rolling mills 12B before an opening is generated in the steel sheet 1, as shown in FIG. 8, for example. According to this knowledge, by monitoring the image of the portion of the steel sheet 1 entering the pair of rolling mills 12B and the vicinity thereof carefully, the operator can detect a sign of opening in the steel sheet 1. When the operator notices a sign of water spouting from the portion of the steel sheet 1 entering the pair of rolling mills 12B, the operator can execute a leveling operation or a bender operation at an early stage, thereby preventing the opening in the steel sheet 1.

Note that the generation of water spouting due to the opening of the steel sheet 1 is desirably recognized automatically through an image analysis of an image obtained by the imaging camera unit 15. Since the opening of the steel sheet 1 has a lower temperature than the other portions, by specifying a portion that turns into black in the red steel sheet 1 through an image analysis of the image obtained by the imaging camera unit 15, the opening of the steel sheet 1 can be recognized automatically. The image analysis can be executed by the above described monitoring apparatus (not shown).

The monitoring apparatus analyzes the image obtained by the imaging camera unit 15, for example, and specifies an area that turns into black from a portion in the image showing the steel sheet 1. Then, the monitoring apparatus calculates the size of the black area per unit size. When the size of the black area per unit size exceeds a predetermined threshold, the monitoring apparatus determines the generation of water spouting from the steel sheet 1, and issues a warning to the operator. That is, the ratio of the black area in the image is a detection condition for detecting the opening of the steel sheet 1. In this manner, by enabling automatic detection of the rolling status of the steel sheet 1 through an image analysis of the obtained image, such as water spouting due to the opening of the steel sheet 1, the monitoring load on the operator can be reduced.

Use Example 5

Figure 9:
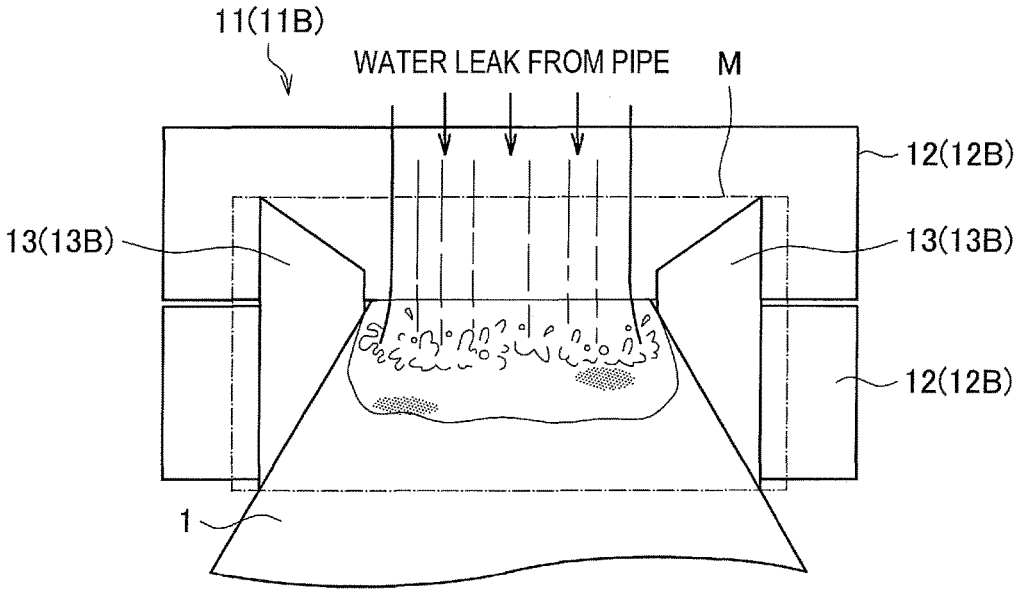
FIG. 9 is a schematic view showing an example in which water leaked by a fault in the equipment is monitored by use of the image obtained by the imaging camera unit according to the embodiment.

In the rolling apparatus 19, water can be leaked by a fault in the equipment, such as a fault of a pipe in the apparatus. When the leaked water covers the steel sheet 1, as shown in FIG. 9, for example, the temperature of the steel sheet 1 decreases locally, leading to a serious trouble. In order to minimize damage caused by such a trouble, it is required to find the fault in the equipment, such as a water leak, at an early stage.

Figure 10:
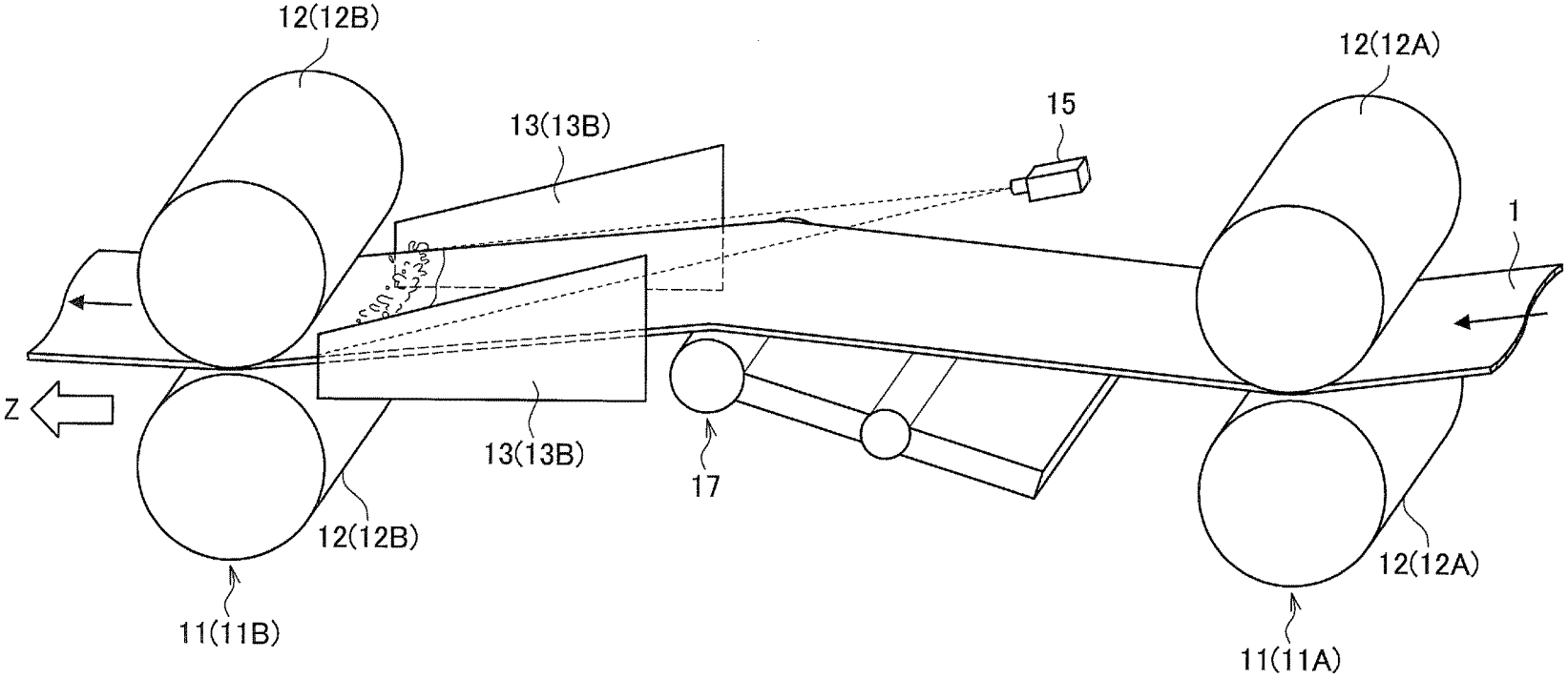
FIG. 10 is a schematic perspective view of a rolling apparatus showing the state shown in FIG. 9.

Conventionally, the water leak due to a fault in the equipment has been determined on the basis of the presence or absence of water on the steel sheet 1, which can be recognized from an image obtained by an imaging unit imaging the conveyed steel sheet 1 from the side or the top. Here, when the water is leaked by a fault in the equipment, the water leaked on the steel sheet 1 flows toward the rolling stand 11B via the looper 17 as a watershed, as shown in FIG. 10. However, the position where the imaging unit can be disposed is limited to the upstream side in the rolling direction Z with respect to the side guides 13B between the adjacent rolling stands 11A and 11B. Therefore, unless a large amount of water is leaked, water leaked on the steel sheet 1 does not appear in the image, so that it has been difficult to find the water leak due to a fault in the equipment at an early stage.

In contrast, by disposing the imaging camera unit 15 as in the rolling apparatus 10 according to this embodiment, the steel sheet 1 entering the pair of rolling mills 12B can be imaged. Therefore, from the obtained image, as shown in FIG. 9, for example, the state in which water leaked on the steel sheet 1 by a fault in the equipment flows to the portion of the steel sheet 1 entering the pair of rolling mills 12B can be recognized. While monitoring the image, by checking carefully whether there is water on the steel sheet 1 at the portion of the steel sheet 1 entering the pair of rolling mills 12B or the vicinity thereof, the operator can find a water leak due to a fault in the equipment at an early stage.

Note that the generation of a water leak due to a fault in the equipment is desirably recognized automatically through an image analysis of the image obtained by the imaging camera unit 15. When water leaks onto the steel sheet 1 owing to a fault in the equipment, a portion on the steel sheet 1 which becomes wet with water has a lower temperature than other portions, and appears as a black area in the image. Accordingly, the image obtained by the imaging camera unit 15 is subjected to an image analysis, and the portion that turns into black in the red steel sheet 1 is specified, and thus the water leak on the steel sheet 1 can be recognized automatically. The image analysis can be executed by the above described monitoring apparatus (not shown).

As in the Use Example 4, the monitoring apparatus analyzes the image and specifies the black area from a portion in the image showing the steel sheet 1. Then, the monitoring apparatus calculates the size of the black area per unit size, and when the size exceeds a predetermined threshold, the monitoring apparatus determines the generation of a water leak on the steel sheet 1, and issues a warning to the operator. That is, the ratio of the black area in the image is a detection condition for detecting a water leak on the steel sheet 1. In this manner, by enabling automatic detection of the rolling status of the steel sheet 1 through an image analysis of the obtained image, such as a water leak on the steel sheet 1, the monitoring load on the operator can be reduced.

The configuration of the rolling apparatus 10 and the rolling monitoring method of the steel sheet according to this embodiment have been described above. The rolling stand 10 includes the imaging camera unit 15 which images the steel sheet 1 entering the pair of rolling mills 12B of the rolling stand 11B on the downstream side in the rolling direction Z. Thus, an image of the steel sheet 1 entering the pair of rolling mills 12B, as shown in FIG. 4, can be obtained, for example. On the basis of this image, the operator can recognize the behavior of the steel sheet 1 entering the pair of rolling mills 12B. Considering the behavior of the steel sheet 1, the operator adjusts leveling setting or the like of the rolling stand 11A on the upstream side, thereby preventing a contact between the side guide 13B and the steel sheet 1 and executing stable rolling of the steel sheet 1.

Further, the imaging camera unit 15 is disposed on the upstream side in the rolling direction Z of the rolling stand 11B, in a central portion in the width direction of the steel sheet in an area P in which the steel sheet 1 is able to be conveyed, so as to satisfy the following equation (1). Accordingly, it becomes possible to obtain an image of the steel sheet 1 entering the pair of rolling mills 12B, as shown in FIG. 4, for example, with a single imaging camera unit 15. On the basis of the image, the operator can recognize the behavior of the steel sheet 1 accurately.

Furthermore, in this embodiment, the imaging camera unit 15 is disposed within a range of 0.5 m in the width direction of the steel sheet from the center C in the width direction of the steel sheet in the area P in which the steel sheet 1 is able to be conveyed, as shown in FIG. 2. Accordingly, it becomes possible to obtain an image by which the behavior of the steel sheet 1 can be recognized intuitively with the imaging camera unit 15.

Furthermore, in this embodiment, the imaging camera unit 15 is disposed at a height to image the steel sheet 1 entering the pair of rolling mills 12B at the tilt angle $\theta$ with respect to the rolling direction Z of the steel sheet 1, as shown in FIG. 1, and the tilt angle $\theta$ is smaller than or equal to 20°. That is, the imaging camera unit 15 is disposed such that the height H of the steel sheet 1 from the position where the steel sheet 1 is conveyed satisfies the following equation (2). Accordingly, with the imaging camera unit 15, it becomes possible to image the steel sheet 1 entering the pair of rolling mills 12B surely, and to obtain an image in which the behavior of the steel sheet 1 can be recognized accurately. Further, even in a case where there is an obstacle above the rolling stand 11B on the downstream side in the rolling direction Z, the imaging camera unit 15 can image the steel sheet 1 entering the pair of rolling mills 12B without being prevented from imaging the steel sheet 1 by the obstacle.

In addition, the horizontal viewing angle $\alpha$ of the imaging camera unit 15 is smaller than or equal to 50°, and is set to 50° in this embodiment. Accordingly, it becomes possible to obtain an image having less strain in which the behavior of the steel sheet 1 entering the pair of rolling mills 12B can be recognized accurately.

Further, in this embodiment, the imaging camera unit 15 includes the case main part 20, the case lens part 30, the camera main body 16, and the air supply part 18 which supplies air to the case main part 20. The case main part 20 is made of a stainless steel having a thickness of 1 cm or more, for example. Such a configuration can prevent early degradation of the camera main body 16 due to heat load or the like. Accordingly, the imaging camera unit 15 can be kept installed all the time between the rolling stands 11 of the final rolling apparatus in the hot-rolling line of the steel sheet 1, and also the operator can recognize the behavior of the rolled steel sheet.

Further, the case lens part 30 is detachably attached to the case main part 20. Therefore, in a case where the lens 33 becomes dirty, only the case lens part 30 needs to be replaced with a new one, resulting in highly efficient maintenance. Furthermore, the case main part 20 and the case lens part 30 are configured to be supplied with air. Therefore, it becomes possible to prevent early degradation of the camera main body 16 and the lens 33 due to head load, fine particles, vapor, and the like.

The rolling apparatus and the rolling monitoring method of the steel sheet according to this embodiment have been described above. However, the present invention is not limited thereto and can be modified as appropriate without departing from the technical idea of the invention.

For example, the configuration of the imaging camera unit is not limited to the examples shown in this embodiment, and an imaging camera unit having a different configuration may be used. However, in a case where the imaging camera unit is used in a final rolling apparatus in a hot-rolling line of a steel sheet, for example, the configuration needs to have durability against heat load, fine particles, vapor, and the like.

Further, configurations of the rolling stand and the side guides are not limited to the examples shown in this embodiment either, and a rolling stand and side guides having different configurations may be used.

REFERENCE SIGNS LIST

1 steel sheet
10 rolling apparatus
11 rolling stand
12 rolling mill
15 imaging camera unit (imaging unit)

The invention claimed is:

1. A rolling monitoring method to monitor a rolling status of a steel sheet that is rolled by a plurality of rolling stands each including a pair of rolling mills, the rolling monitoring method comprising:

imaging the steel sheet entering the pair of rolling mills of the rolling stand located on a downstream side in a rolling direction, with an imaging unit disposed between adjacent rolling stands so as to satisfy the following equation (1), on an upstream side in the rolling direction of the rolling stand located on the downstream side in the rolling direction, in a central portion in a width direction of the steel sheet in an area in which the steel sheet is able to be conveyed; and displaying, on a display apparatus, an image of the steel sheet entering the pair of rolling mills, the image being obtained by the imaging unit:

$$2\times L\times\tan(\alpha/2)>W_{max} \quad (1)$$

wherein L represents a distance in the rolling direction between the rolling stand located on the downstream side in the rolling direction and the imaging unit, $\alpha$ represents a horizontal viewing angle of the imaging unit, and $W_{max}$ represents a maximum width of the steel sheet, and wherein, when it is determined that detection conditions for detecting a specific rolling status of the steel sheet are satisfied as a result of an image analysis of the image of the steel sheet, a warning is issued by displaying of the warning content on said display apparatus or by a sound.

2. A rolling apparatus comprising:

a plurality of rolling stands each including a pair of rolling mills; and an imaging unit provided between adjacent rolling stands, the imaging unit being configured to image a steel sheet entering the pair of rolling mills of the rolling stand from an upstream side of the rolling stand located on a downstream side in a rolling direction, wherein the imaging unit is disposed so as to satisfy the following equation (1), on the upstream side in the rolling direction of the rolling stand located on the downstream side in the rolling direction, in a central portion in the width direction of the steel sheet in an area in which the steel sheet is able to be conveyed:

$$2\times L\times\tan(\alpha/2)>W_{max} \quad (1)$$

wherein L represents a distance in the rolling direction between the rolling stand located on the downstream side in the rolling direction and the imaging unit, $\alpha$ represents a horizontal viewing angle of the imaging unit, and $W_{max}$ represents a maximum width of the steel sheet, and wherein the imaging unit is disposed at a height to image the steel sheet entering the pair of rolling mills at a tilt angle $\theta$ with respect to the rolling direction of the steel sheet, the tilt angle $\theta$ being smaller than or equal to 20°.

3. The rolling apparatus according to claim 2, wherein the imaging unit is disposed within a range of 0.5 m in the width direction of the steel sheet from a center in the width direction of the steel sheet in the area in which the steel sheet is able to be conveyed.

4. The rolling apparatus according to claim 2, wherein the horizontal viewing angle $\alpha$ of the imaging unit is smaller than or equal to 50°.

5. The rolling apparatus according to claim 4, wherein the imaging unit is disposed within a range of 0.5 m in the width direction of the steel sheet from a center in the width direction of the steel sheet in the area in which the steel sheet is able to be conveyed.

6. A rolling apparatus comprising:

a plurality of rolling stands each including a pair of rolling mills; and an imaging unit provided between adjacent rolling stands, the imaging unit being configured to image a steel sheet entering the pair of rolling mills of the rolling stand from an upstream side of the rolling stand located on a downstream side in a rolling direction, wherein the imaging unit is disposed so as to satisfy the following equation (1), on the upstream side in the rolling direction of the rolling stand located on the downstream side in the rolling direction, in a central portion in the width direction of the steel sheet in an area in which the steel sheet is able to be conveyed:

$$2\times L\times\tan(\alpha/2)>W_{max} \quad (1)$$

wherein L represents a distance in the rolling direction between the rolling stand located on the downstream side in the rolling direction and the imaging unit, $\alpha$ represents a horizontal viewing angle of the imaging unit, and $W_{max}$ represents a maximum width of the steel sheet, and wherein the horizontal viewing angle $\alpha$ of the imaging unit is smaller than or equal to 50°.

7. The rolling apparatus according to claim 6, wherein the imaging unit is disposed within a range of 0.5 m in the width direction of the steel sheet from a center in the width direction of the steel sheet in the area in which the steel sheet is able to be conveyed.

* * * * *